US007617619B2

(12) United States Patent
Cox

(10) Patent No.: US 7,617,619 B2
(45) Date of Patent: Nov. 17, 2009

(54) PREHENSILE BUCKET ATTACHMENT

(75) Inventor: Clay Cox, New Braunfels, TX (US)

(73) Assignee: Entek Manufacturing, Inc., Seguin, TX (US)

( * ) Notice: Subject to any disclaimer, the term of this patent is extended or adjusted under 35 U.S.C. 154(b) by 0 days.

(21) Appl. No.: 12/220,773

(22) Filed: Jul. 28, 2008

(65) Prior Publication Data

US 2008/0282585 A1 Nov. 20, 2008

Related U.S. Application Data

(60) Provisional application No. 61/012,385, filed on Dec. 7, 2007, provisional application No. 61/001,163, filed on Oct. 31, 2007.

(51) Int. Cl.
*E02F 3/96* (2006.01)

(52) U.S. Cl. ..... 37/406; 414/729

(58) Field of Classification Search ..... 37/403, 37/406, 466, 468, 903; 414/724, 729, 912
See application file for complete search history.

(56) References Cited

U.S. PATENT DOCUMENTS

| | | | |
|---|---|---|---|
| 2,328,715 | A | 9/1943 | Drott |
| 3,252,606 | A | 5/1966 | Pryor |
| 3,461,968 | A | 8/1969 | Longley |
| 3,737,059 | A | 6/1973 | Peterson et al. |
| 3,767,070 | A | 10/1973 | Arnold |
| 4,283,866 | A | 8/1981 | Ogawa |
| 4,375,345 | A | 3/1983 | Hanson |
| 4,407,626 | A | 10/1983 | Bruckner |
| 5,111,602 | A | 5/1992 | Risch |
| 5,314,292 | A | 5/1994 | Holopainen |
| 5,649,377 | A | 7/1997 | Tanada |
| 5,678,332 | A | 10/1997 | Hawkins |
| 5,927,933 | A | 7/1999 | Tucker |
| 6,203,267 | B1 | 3/2001 | Heiple et al. |
| 6,385,870 | B1 | 5/2002 | Webel et al. |
| 6,589,007 | B2 | 7/2003 | Burton |
| 6,612,051 | B2 | 9/2003 | Weyer et al. |
| 6,640,471 | B2 | 11/2003 | Desrochers |
| 6,742,291 | B2 | 6/2004 | Frigon et al. |
| 7,096,610 | B1 | 8/2006 | Gilmore |
| 7,111,419 | B1 | 9/2006 | Miller |

OTHER PUBLICATIONS

Martin brochure for Hydraulic Quick Coupler.
Martin brochure for Twin Thumb Bucket.

*Primary Examiner*—Robert E Pezzuto
(74) *Attorney, Agent, or Firm*—Mark H. Miller; Daniel Chapman; Jackson Walker LLP

(57) ABSTRACT

An prehensile excavator bucket includes a bucket and a reinforced thumb hingedly affixed to the bucket and that is controlled in conjunction with the bucket for purposes including seizing very heavy items. The thumb may be a single internally-static unit having multiple tines reinforced with metal tubes. The prehensile bucket may have a quick couple receptor so that it can be quickly attached to and detached from an excavator stick with a quick couple mechanism. Because the thumb is permanently attached to the bucket, the thumb and bucket together form a single unit strong enough for gripping and moving very heavy items.

26 Claims, 10 Drawing Sheets

PREHENSILE BUCKET ATTACHMENT

This application claims the benefit of and incorporates by reference Provisional Patent Applications No. 61/012,385, filed on Dec. 7, 2007, and 61/001,163 filed Oct. 31, 2007.

FIELD OF THE INVENTION

This invention relates to engineering vehicles and more particularly to a prehensile bucket attachment for an excavator or backhoe.

BACKGROUND

An excavator is a type of engineering vehicle that may be used for purposes including construction, demolition and excavation. A bucket is an attachment to an excavator that is used, among other things, for scooping, digging, and excavation. A thumb is an accessory device for an excavator, and may be welded or attached to the excavator's stick to provide opposable force to the bucket.

SUMMARY OF THE INVENTION

Figure 1:
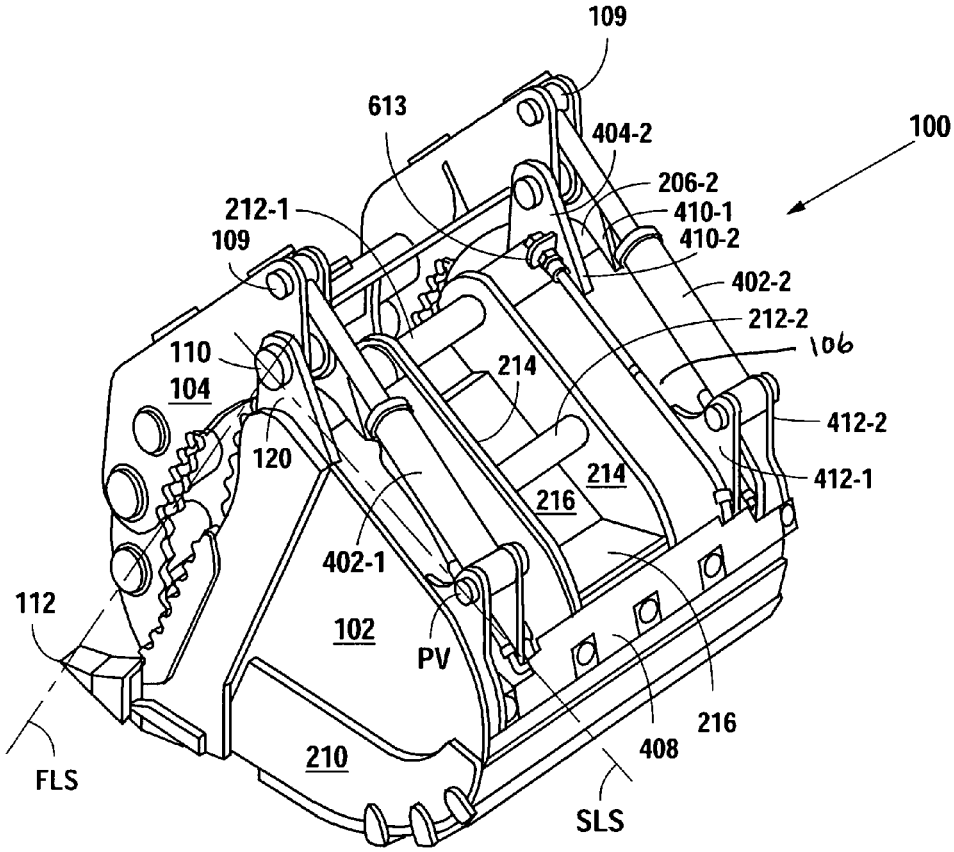
FIG. 1 is a perspective view of a first embodiment of a prehensile bucket.

With reference generally to the Figures and the specification set forth herein, an embodiment of Applicant's invention includes an attachment for an engineering vehicle having a stick and an engineering vehicle hydraulic system. The attachment would typically comprise a bucket, the bucket having a cavity, a mouth, a bottom front edge, a top front edge, side walls, a top wall, a curved rear wall, and a bottom wall. The bucket typically includes teeth at the lower front edge thereof, the teeth having interteeth spaces. The bucket may include a pair of spaced apart thumb support members and a pair of thumb retainer pins engaged therewith. The bucket would typically include a pair of spaced apart hydraulic cylinder engaging members located on a bucket top and spaced away from thumb support members on the bucket external walls and toward a curved portion of the bucket. Hydraulic cylinder engaging members of the bucket would also typically include a pair of hydraulic cylinder retainer pins. The bucket includes upper and lower stick engaging members or pins and thereupon, stick engaging members typically located inboard of the thumb support members and the hydraulic cylinder engaging members, and the upper and lower stick engaging members for coupling to the stick which in turn will raise and lower, extend and retract the bucket.

A pair of hydraulic cylinders are included in Applicant's prehensile bucket with each hydraulic cylinder having a first end and a second end and constructed in a unique manner for use with respect to engineering vehicles. All cylinders have ports, but these cylinders have a single block port at the rear, connected by a hard line tubing to the front of the cylinder.

A thumb is provided for pivotal engagement with Applicant's bucket, the thumb having multiple tines. The tines trend generally transverse between the top and bottom front edges at least partially across the mouth of the bucket and have tine tips at the removed ends thereof. The thumb is pivotally engaged to the bucket for moving between an opened and a closed position. Typically, at least some of the tine tips engage the interteeth spaces of the bucket. Typically, an outboard pair of the multiple tines have a near end adapted to engaging the thumb support members and the hydraulic cylinders. The thumb includes at least one spacing member to laterally space the multiplicity of tines apart from one another yet attach the tines so that the combination of the tines and the at least one spacing member pivots causing the thumb to act as a unit.

The thumb and the bucket mouth define a jaw. The bucket may also include a hydraulic subsystem for fluidly engaging the hydraulic cylinders of the hydraulic system from the engineering vehicle and a lever mounted in the control cab for selectively expanding and contracting the hydraulic cylinder and thereby opening and closing the jaw of the attachment.

In one aspect, a prehensile excavator bucket includes a bucket and a reinforced, moveable thumb attached to the bucket that is controlled in conjunction with the bucket for purposes including seizing very heavy items. The thumb may be a single internally-static unit having multiple tines reinforced with metal tubes. The prehensile bucket may have a quick couple mechanism so that it can be quickly attached to and detached from an excavator stick. Because the thumb is attached to the bucket and not the stick, the thumb and bucket together form a single unit strong enough for gripping and moving very heavy items.

The bucket and thumb combination is designed for use on any size hydraulic excavators, compact hydraulic excavators and backhoe loaders, including without limit, rubber-tire backhoe loaders. This device combines the design of a coupler bucket with a light, yet durable hinging hydraulic thumb. The design effectively maintains the time saving advantages gained by the application of a quick coupler, while providing an excavator with improved versatility and maximized performance. The design allows any hydraulic excavator or backhoe loader equipped with a thumb hydraulic circuit to be tooled and ready in minutes rather than in hours.

The bucket and thumb act in unison; one cab mounted hydraulic control lever allows the opening and closing of the jaws defined by the thumb and bucket. This allows greater work efficiency, agility, control safety, and ease of operation. The alternative has been to use a thumb that would manually (with a hydraulic control lever) chase the bucket to stay closed on a load. Therefore, this new combination design is inherently safer. The design, because of its secure grip and single lever control, is safer than previous conventional designs.

An embodiment of the design has dual cylinders for double the force available on the older typical single cylinder thumbs. This provides a gripping force in a magnitude capable of lifting the machine that operates it in most cases. The dual cylinder and cross tube thumb construction contribute to its resistance to tensional frame loads that exceeds the existing excavator thumb styles. The spacing of the tubes eliminates some of the usual operator vision blind spots.

There is usually no welding required to install an embodiment of this design to an excavator machine, only the plumbing of the hydraulics to the machine fluid supply. An embodiment of this design is created to be a single tool with no special paraphernalia to keep track of. The operation of this new bucket and thumb combination has been compared to pliers for an excavator. The device has been used for building stone walls, excavating building and loading debris, clearing fallen timbers and pulling concrete piers from the earth.

Hydraulic cylinders, typically a pair, operate between a rear face of a rear wall of the bucket fully retracting to open jaws enough to dig with the bucket and to maintain a proper digging angle.

When the tines are fully closed, the cylinders are at or near maximum extension. When the jaw is fully open, the cylinders are at or near maximum retraction. The moment arm driving the thumb about the bucket is generally perpendicular to the drive line of the hydraulic cylinders somewhere between the fully opened and fully closed position, typically providing an angular jaw opening of approximately 0-45 degrees.

Torque tubes perpendicular to the tines are spaced to eliminate operator vision blind spots.

A single lever is used to control the opening and closing of the thumb which will open and close regardless of the positions of the bucket.

Grease fittings typically found on all rotating joints, including the joint where the thumb pivots with respect to the bucket and the joint where the cylinders engage the thumb.

DETAILED DESCRIPTION OF PREFERRED EMBODIMENTS

A prehensile bucket will now be described with more particular reference to the attached drawings. Hereafter, details are set forth by way of example to facilitate discussion of the disclosed subject matter. It should be apparent to a person of ordinary skill in the field, however, that the disclosed embodiments are exemplary and not exhaustive of all possible embodiments.

FIG. 1 is a perspective view of an exemplary embodiment of a prehensile bucket, which may be adapted for use with an engineering vehicle, for example a 40,000-pound operating weight excavator. A prehensile bucket 100 includes a bucket 102 and a thumb 104. The bucket 102 and thumb 104 are attached at a pivot point 110, which allows thumb 104 to hingedly rotate with respect to bucket 102. Hinged rotation is actuated by a hydraulic subsystem 106 (see also FIG. 5). Bucket 102 may include teeth 204, each of which may include a tooth tip 112. An angle called the opening angle 120 may be described by two line segments. The first line segment FLS joins pivot point 110 to tooth tip 112 or a similar extremity. The second line segment SLS joins pivot point 110 to pivot point PV (where the cylinders pivot against the bucket. The opening angle varies as thumb 104 moves from a fully closed position to a fully open position. In the fully-closed position (FIG. 1), the angle between the line segments may be approximately 84 degrees. For simplicity, the fully-closed position may be used as a reference angle 120, and the opening angle 108-1 (see FIG. 1C) may be described as an offset from that position. So in the fully-closed position, the opening angle is 0 degrees. In the depicted embodiment, the maximum opening angle 108-1 (when thumb 104 is fully open) may be at least 95 degrees (a total angle of 179 degrees between the two line segments). A typical opening angle range is up to about 100 degrees or more, if possible.

Because thumb 104 hingedly rotates relative to bucket 102, thumb 104 provides opposable force to bucket 102, which is similar to the action of fingers opposing thumbs in humans. The provision of opposable force gives the combination of thumb 104 and bucket 102 the ability to grip or grasp objects, including objects that have irregular shapes or are very heavy. This gripping or grabbing constitutes prehensile action by thumb 104 and bucket 102.

Figure 2:
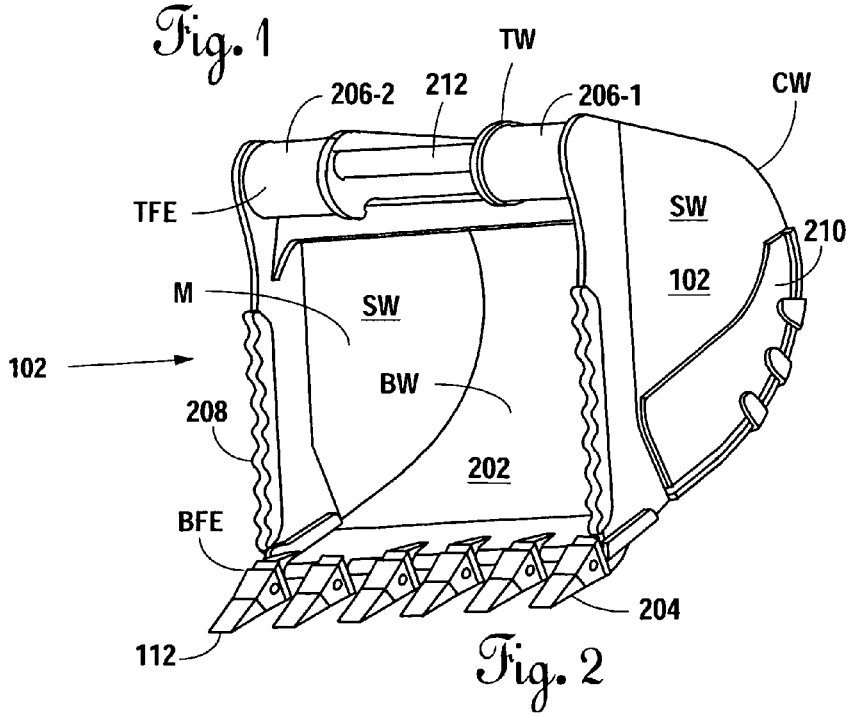
FIG. 2 is a perspective view of a first embodiment of a bucket configured to receive a thumb and to form a prehensile bucket.

FIG. 2 provides a reference to different areas or sections on bucket 102. Bucket 102 includes a top front edge TFE spaced apart from a bottom front edge BFE and a pair of side walls SW, the leading edge of the side walls, TFE and BFE generally defining a bucket mouth M. The side walls engage a rear wall having a top wall TW, a curved wall CW, and a bottom wall BW.

FIG. 2 is a perspective view of an exemplary embodiment of a bucket 102 configured to receive a thumb 104. The bucket 102 includes a cavity 202 with a selected volumetric capacity. Teeth 204 aid in digging and cutting. Bucket torque tubes 206 are provided as a mounting point for pivot mount ears 410-1 and 410-2 (FIG. 1). A quick couple receptor 212 may be provided for interfacing with a quick couple mechanism on an excavator. Side cutters 208 are also shown, which may be welded on to the bucket 102 or may be bolted on. Wear plates 210 provide protection against wear on the bucket structure, and in some embodiments, may be constructed of metal, or alternatively of acetyl or any natural, synthetic or composite material appropriate for providing a wear buffer to the bucket 120.

Figure 3:
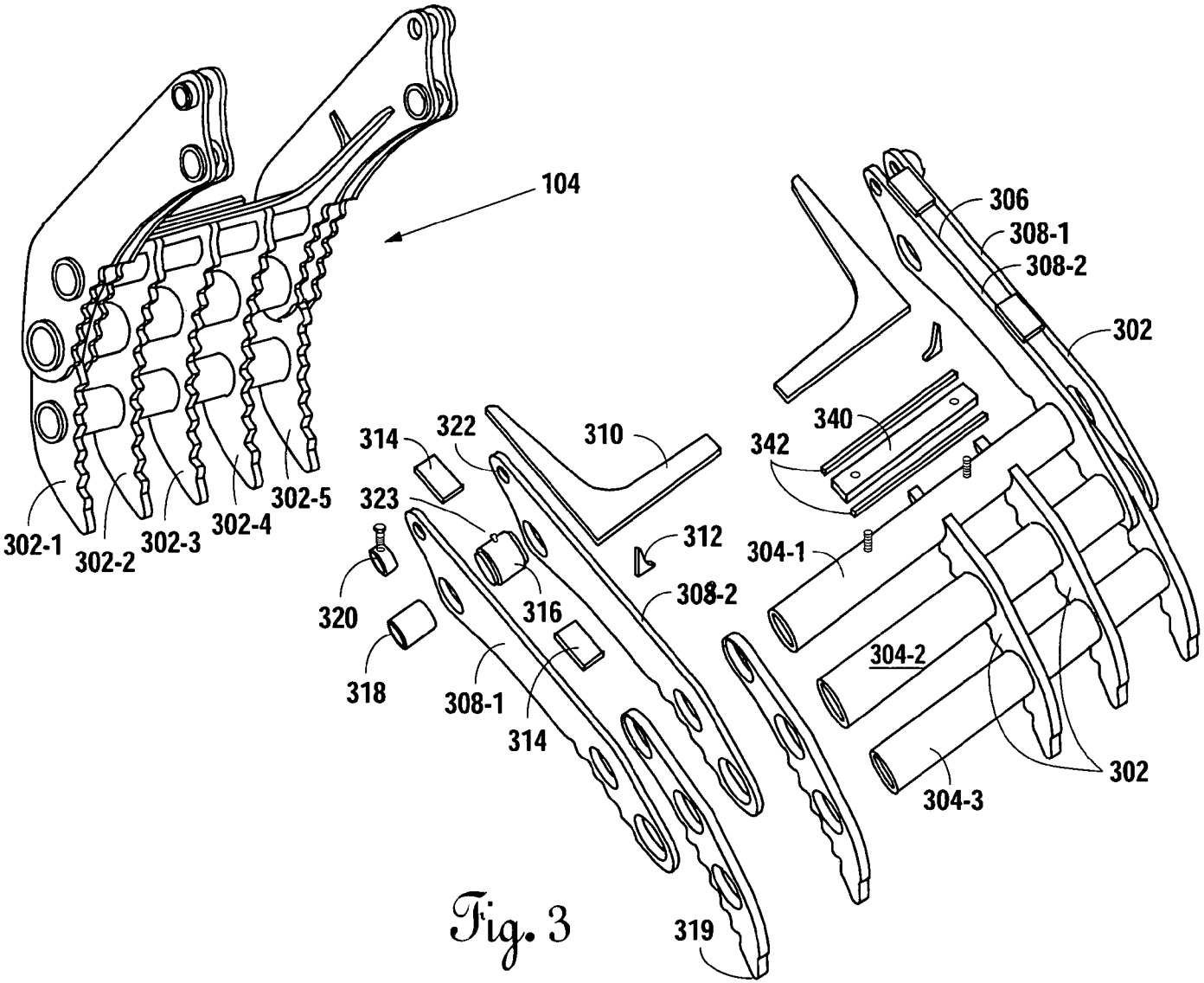
FIG. 3 is a first embodiment of a reinforced thumb adapted to attach to a bucket to form a prehensile bucket.

FIG. 3 is an exemplary embodiment of a reinforced thumb 104 adapted to attach to bucket 102 (FIG. 1). Thumb 104 includes a plurality of tines 302, which together form a single, internally static unit, meaning the tines are not intended to move with respect to each other. The tines 302 may be separated and reinforced by reinforcing pipes or torque tubes 304 which may be steel tubes. In other embodiments, tines 302 may be separated and supported by other structures, such as steel plates, braces or bars. The tines can be constructed of 1¼ inch-thick metal, but may also vary in a range of between ¾ inch and 1½ inch or any suitable thickness. The two outer tines are attached to a pivot arm 306 including two pivot arm plates 308-1 and 308-2. Pivot arm plates 308 may be separated and braced by arm spacers 314 and by pivot arm bosses 316. A replaceable pivot arm bushing 318 may be seated inside each pivot arm boss 316. Grease (Zerk) fittings 323 may be provided as shown. There are also holes 322 adapted to receive a hydraulic pin retainer 320. Hydraulic pin retainer 320 retains pin 321 (see FIG. 4) and is adapted to allow connection to the hydraulic cylinders of the hydraulic subsystem 106. In this embodiment, the pivot arm plate 308 may be constructed of ¾ inch metal or a range of between ½ inch and 1½ inch metal.

Figure 4:
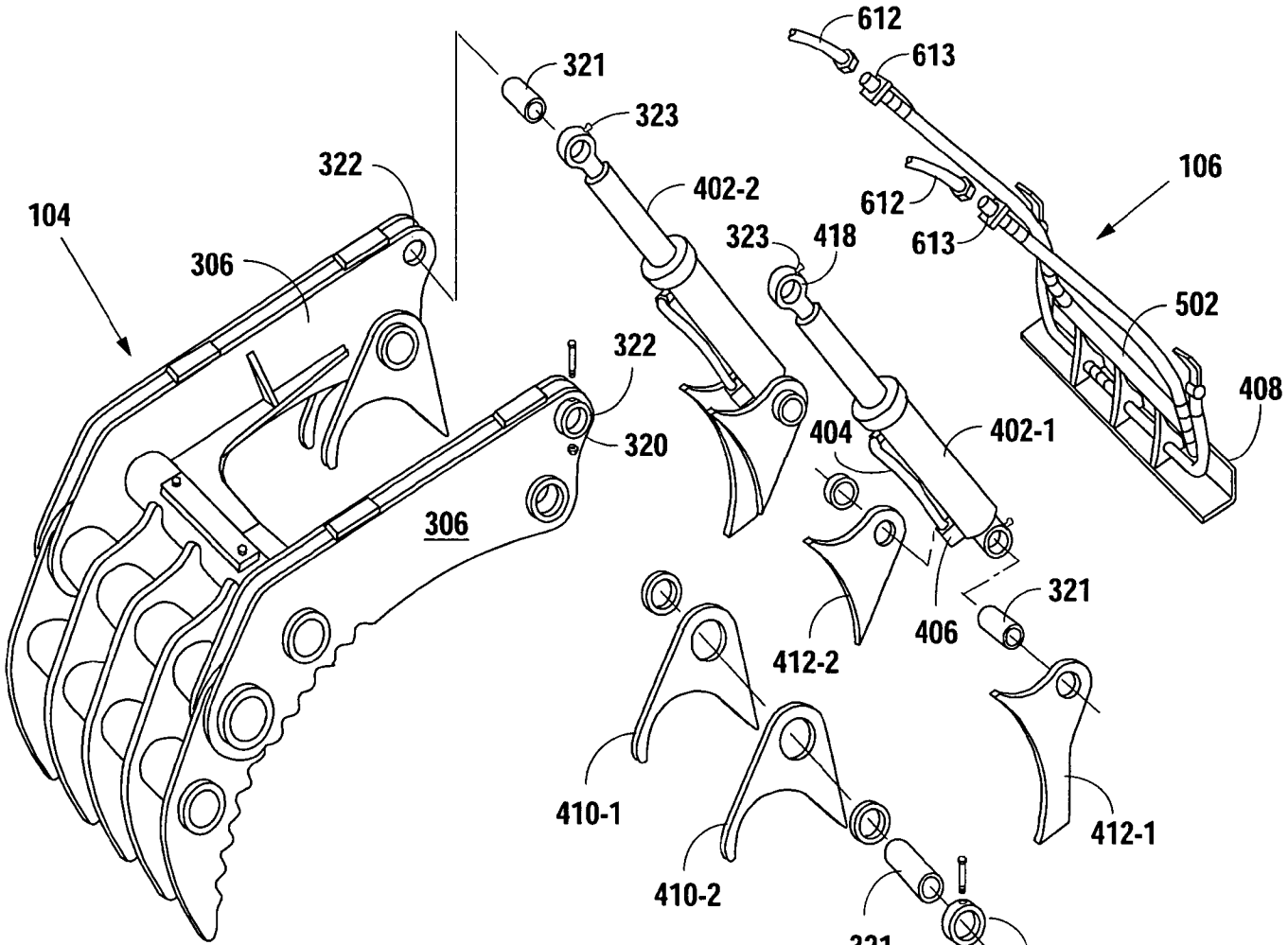
FIG. 4 is a breakout perspective view of a first embodiment of a reinforced thumb also showing hydraulic cylinders and connectors.

FIG. 4 is a breakout view of a first embodiment of a reinforced thumb, also showing hydraulic cylinders and connectors. Hydraulic subsystem 106 engages hydraulic cylinders 402. Hydraulic cylinders 402 may include hard line conduits 404. The hard line conduits 404 may be constructed of the same or a similar metal as the outside of the hydraulic cylinders 402. The hard line conduits 404 are terminated at one end by a port block 406. The hydraulic cylinders 402 may connect via boss fitting 418 to thumb 104 at the hydraulic cylinder holes 322. Grease fittings 323 may be provided as shown. The thumb 104 is also connected at pivot arm boss 306 to pivot mount ears 410. Pivot mount ears 410 are welded on to the bucket. A bent plate cover 408 may be added to protect the hydraulic supply hoses 502 (FIG. 5) from cuts and abrasions while the attachment is in operation. A pair of cylinder/bucket pivot plates 412-1 and 412-2 provide engagement with either side of hydraulic cylinders 402-1 and 402-2 for attachment (pivotally) of the cylinders with the bucket (see FIG. 4).

Figure 5:
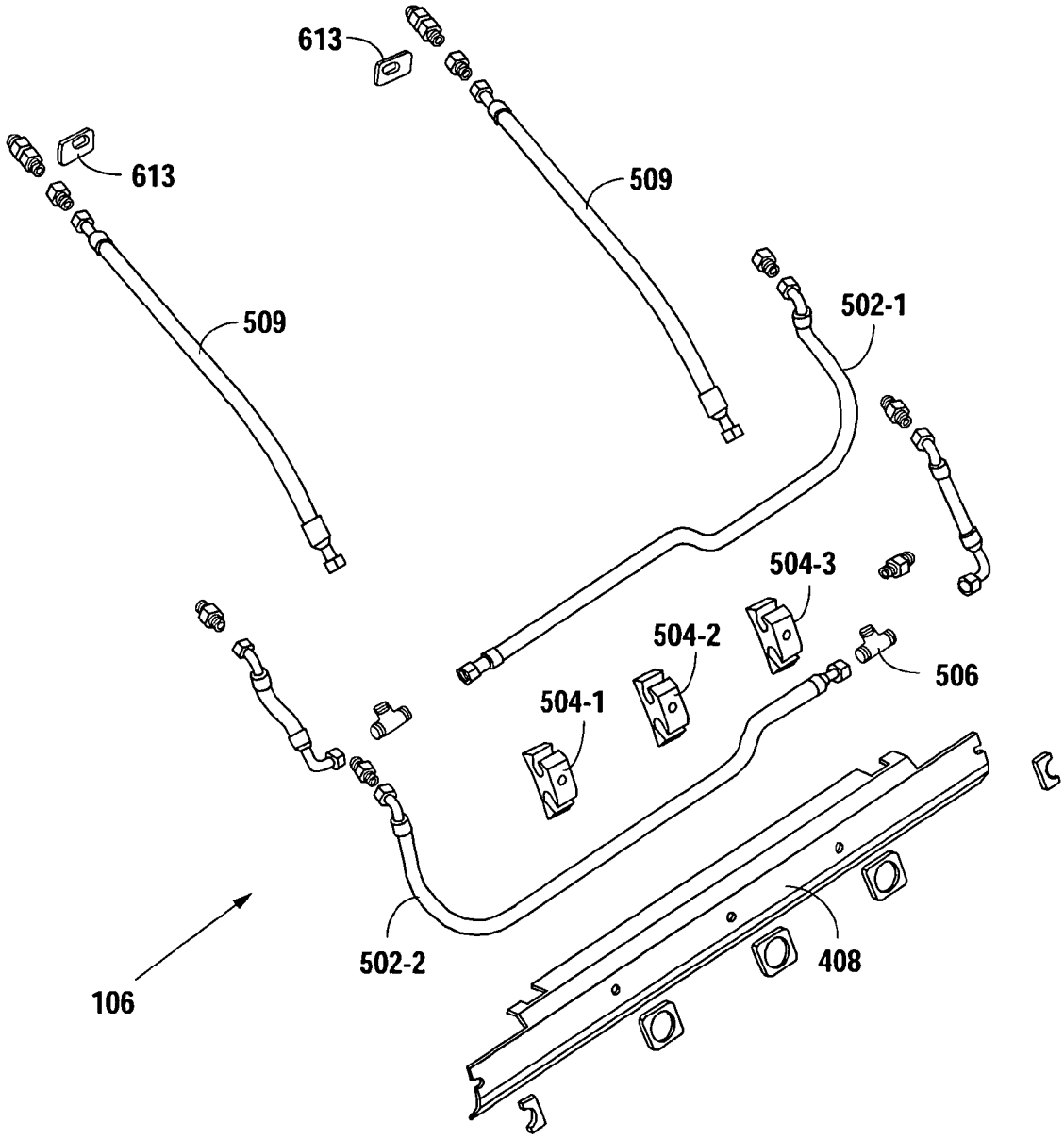
FIG. 5 is a breakout perspective view of hydraulic hoses and connectors for use in an embodiment of a prehensile bucket.

FIG. 5 is a detailed view of an embodiment of a hydraulic subsystem 106, with hydraulic cylinders 402 (FIG. 4) omitted to provide a more detailed view of other elements. Hydraulic hoses 502 are provided to route hydraulic fluid to the hydraulic cylinders 402 (FIG. 4), and may be constructed of a heavy-duty reinforced rubber, such as the steel-ribbed Aeroquip™. Hydraulic hoses 502 may be joined by hydraulic connectors 506. Hydraulic hoses 502 may be secured by retaining blocks 504. Supply and return lines 509 tie into bulkhead fittings 613 (see also FIG. 1) for receiving.

Figure 2A:
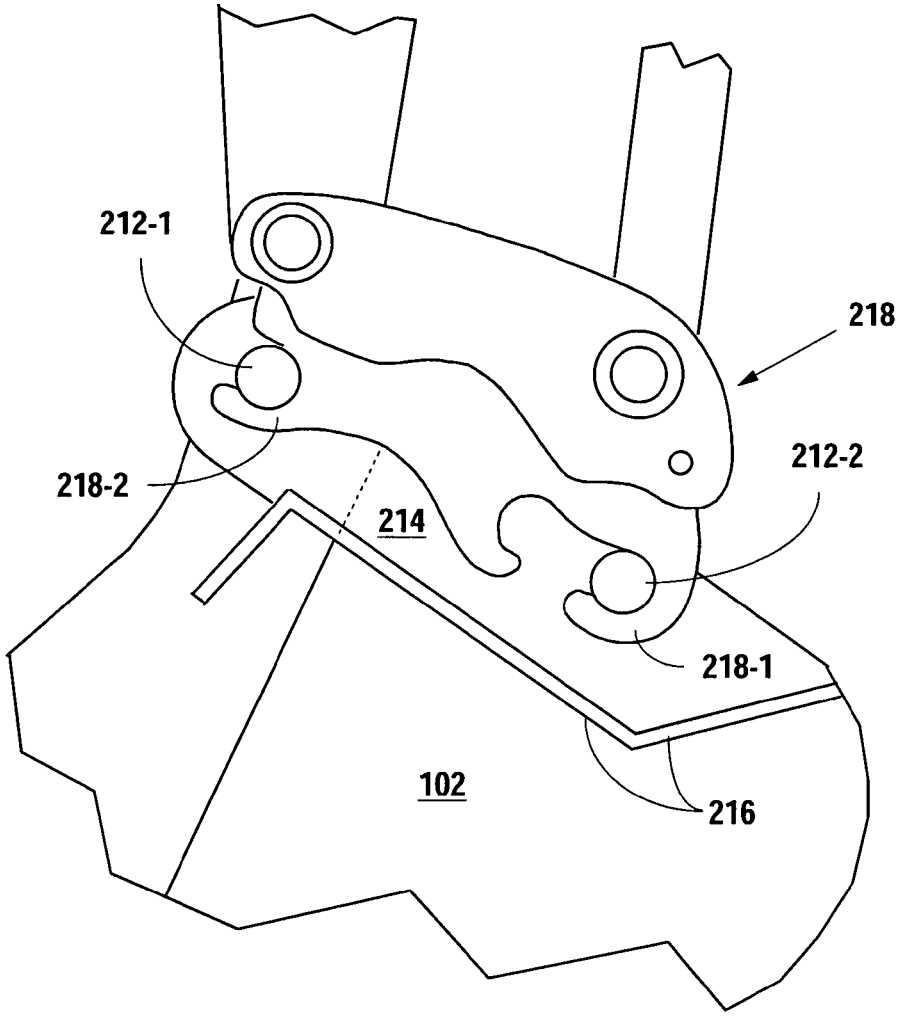
FIG. 2A is a partial side elevational view of a quick coupler mechanism engaging the bucket.
Figure 6:
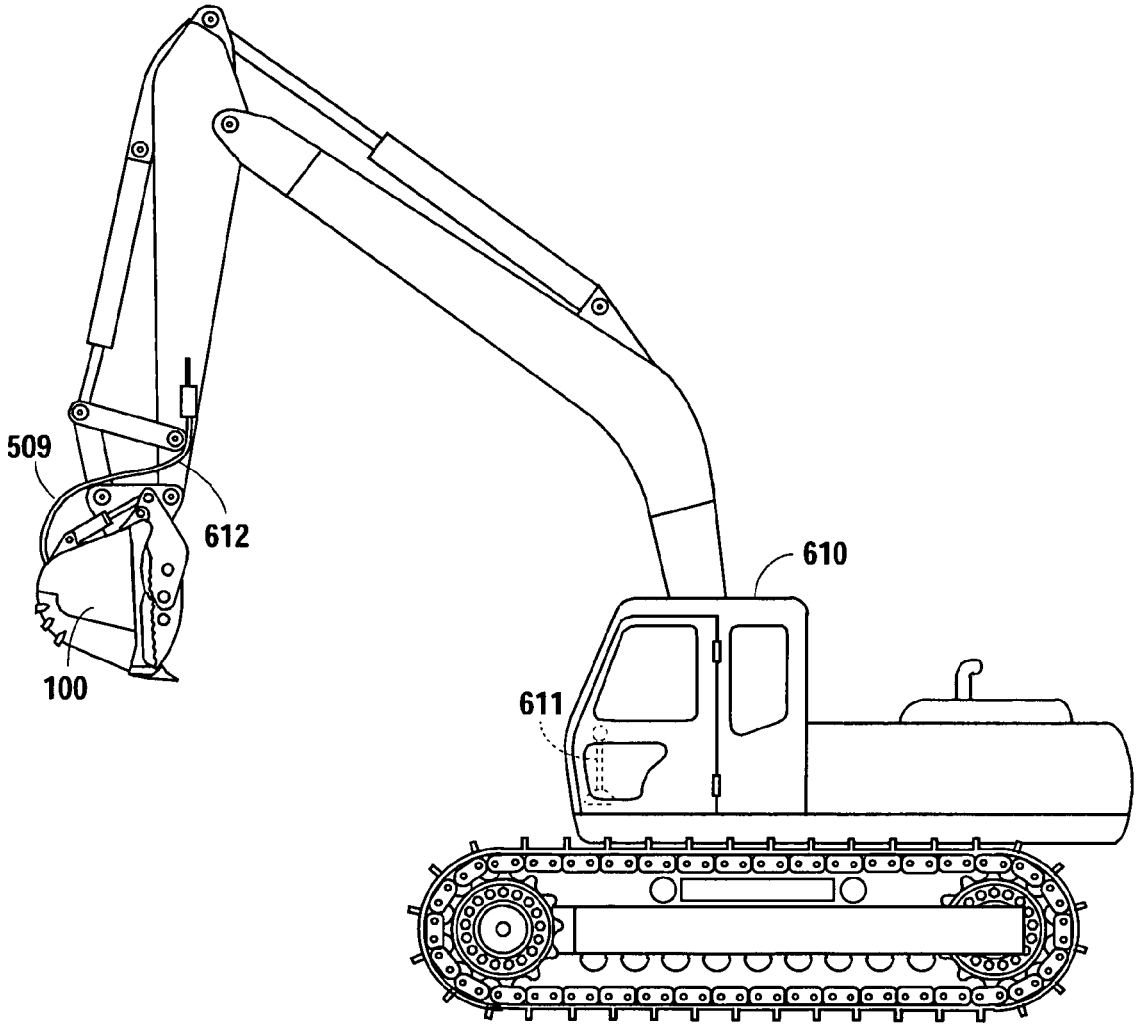
FIG. 6 is a perspective view of an excavator equipped with a prehensile bucket.

FIG. 6 is a side view of an exemplary embodiment of an excavator 610 equipped with a prehensile bucket attached. Excavator 610 includes a stick member 612. The stick 612 is adapted to receive an attachment, which in this case is a prehensile bucket 100. Stick 612 may include a quick couple mechanism (FIG. 2A) that is adapted to interface with a quick couple receptor 212. Control lever 611 controls jaw opening. Supply and return lines 609 engage hydraulic subsystem 106 to the hydraulic system of the machine, through bulkhead fitting 613 (see FIGS. 1 and 5).

Although the paragraphs above describe, by way of example, a prehensile bucket 100 suitable for use with a 40,000-pound operating weight excavator, the basic concept of a prehensile bucket 100 may be adapted for use with other sizes of excavators. Table 1 below lists some exemplary characteristics of prehensile buckets that may be used with various sizes of excavators.

TABLE 1

Alternative Embodiments

| Operating Wt. (Pounds) | Bucket Capacity (Cubic Yards | Total Tines | Tine Thickness (Exemplary/ Range) | Typical Opening Angle | Total Angle |
|---|---|---|---|---|---|
| 30,000 | 0.7 | 4 | 1<br>¾-1¼ | 94° | 194° |
| 40,000 | 1.3 | 4 | 1¼<br>1-1½ | 95° | 179° |
| 55,000 | 1.8 | 4 | 1½<br>1¼-1¾ | 89° | 195° |
| 70,000 | 2.2 | 4 | 1½<br>1¼-1¾ | 89° | 194° |
| 100,000 | 3.0 | 5 | 1½<br>1¼-1¾ | 103° | 204° |

Because of these superior characteristics, the present system is useful for easing or enabling numerous tasks that an excavator might perform. For example, an excavator equipped with the present system can firmly grasp a pylori embedded in the ground and pull it out, or pick up and hold a large rock, or more easily collect and move debris. In one embodiment, of the present system, an prehensile bucket can exert a maximum linear force of at least 72,000 pounds.

Figure 1A:
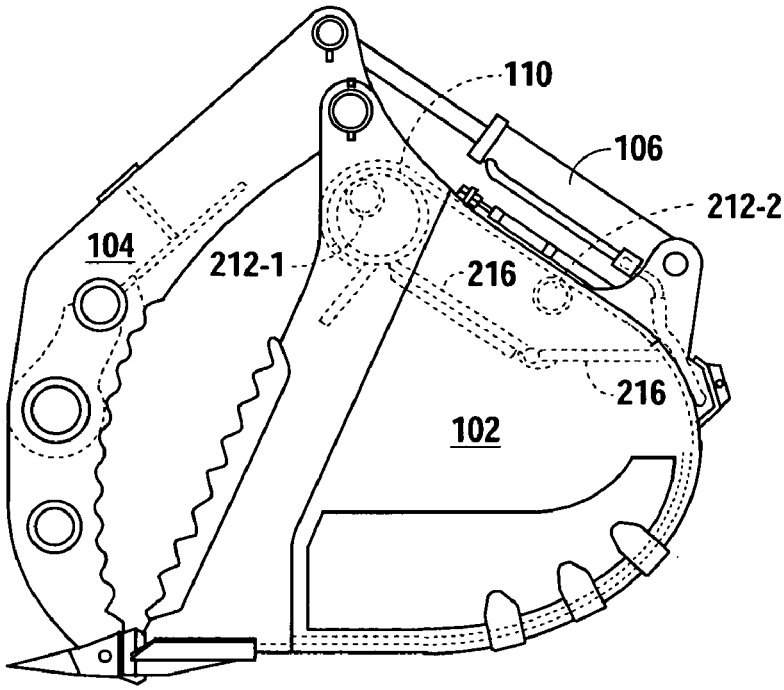
FIGS. 1A and 1B are side elevational and rear elevational views of an embodiment of Applicant's novel prehensile bucket with a thumb attached to a bucket having recessed ears.

Turning back to FIGS. 1 and 1A, it is seen that an embodiment of the invention comprises a quick couple receptor 212. More specifically, quick couple receptor 212 is seen to include an upper member or pins 212-1 and a lower member or pins 212-2. Moreover, it is seen that these members may be recessed, that is, the pins are generally within the side wall profile of the bucket 102 as best seen in FIG. 1A. Further, it is seen with respect to FIGS. 1 and 1A that the quick couple receptor 212 is protected by a pair of laterally spaced receptor cavity side plates or recessed ears 214 and receptor cavity bottom plates 216. The use of recessed members, 212-1 and 212-2, help ensure, when the members are coupled to the quick connector (see FIG. 2A) that the manufacturer's suggested bucket curl radius is restored. In an alternate preferred embodiment (see FIGS. 1C-1F), the upper and lower members may be mounted generally outside the profile of the bucket. The upper and lower members may be chrome and help eliminate the loss of some of the breakout force as would occur with typical excavated buckets. Also, in another embodiment, one of the pins, for example, upper member 212-1, may be recessed and the lower member or pin 212-2 may be external.

With reference to FIGS. 1 and 1A, it is seen that Applicant's prehensile bucket 100 is comprised of a single unit incorporating the bucket 102, the thumb 104, attached to the pivot point 110, the pivot point integral with the bucket, with the hydraulic cylinders 402-1 and 402-2, which drive the thumb pivotally with respect to the bucket, also attached to the bucket at one end and the thumb at the other end. With such structure, one need only engage the quick couple connector 218 (see FIG. 2A) of the stick to the quick connector couple receptor 212 and the hydraulic subsystem 106 to the auxiliary hydraulic system of the excavator. One such line of quick couplers is manufactured by Miller. Quick couplers are known in the art.

Figure 1B:
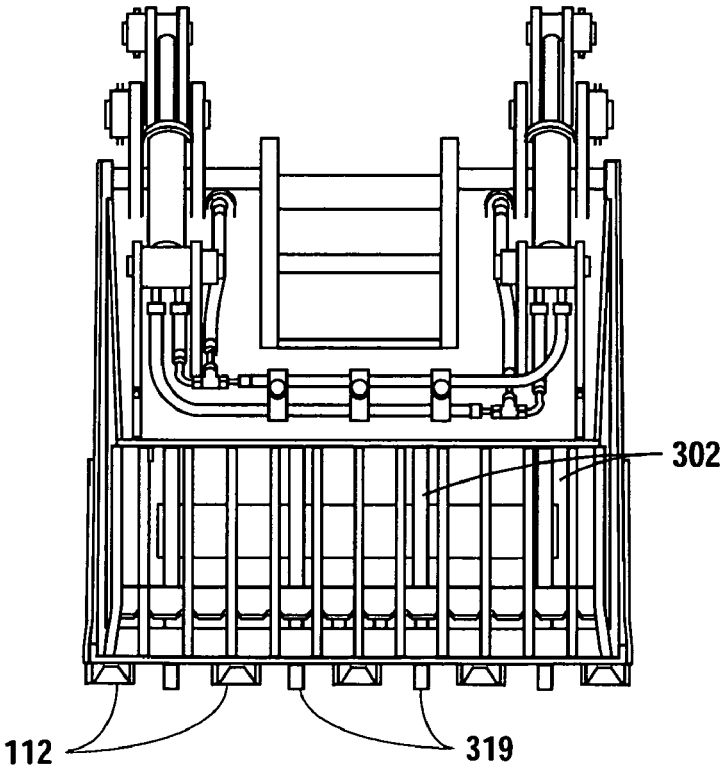

As best seen in FIG. 1B, an embodiment of Applicant's novel prehensile bucket includes a thumb 104 whose tines 302 run the full width of the bucket mouth. That is to say, tines 302 mesh between all the spaces or interteeth gaps between teeth 112, such that there is typically one less tine than there are teeth. For example, in FIG. 1B, there are five teeth and four tines, the tines form a full length thumb 104 covering all of the inter-teeth spaces in meshing relation (see also FIG. 1A). In an alternate preferred embodiment, thumb may define a width which leaves some inter teeth gaps open, for one example, the outermost inter-teeth gap on either side of the bucket mouth. In one such embodiment, in FIG. 1B, there would only be a pair of tines, the pair connected by the lead line between the reference numeral and the element 318.

The assembly of the thumb as best seen in FIG. 3 includes a multiplicity of typically cylindrical torque tubes, here, three torque tubes designated 304-1, 304-2 and 304-3. They are seen to trend generally transverse to tines 302 through openings in the tines and may be welded to the tines as well as the pivot arm plates (here, torque tubes 304-1 and 304-2) to help strengthen the thumb. They will also help prevent twisting of the thumb as when one or two tines or an outboard tine grabs an item and the remaining tines are unloaded. Furthermore, in the embodiment illustrated in FIG. 3, it is seen that a pair of plates 308-1 and 308-2 are provided with spacers 314 and pivot arm bosses 316. Alternately, a single plate may be provided on either side rather than a pair of pivot arm plates 308-1 and 308-2. The removed ends of tines may define a tine tip 319. Moreover, while three torque tubes are illustrated in FIG. 3, in an alternate preferred embodiment, a different number of torque tubes may be used, in two embodiments either two or four may be provided. Further, with respect to FIG. 3, it is seen that the tines may include serrated edges which face the bucket and are generally opposed to the side cutters 208 as seen in FIG. 2.

Figure 2B:
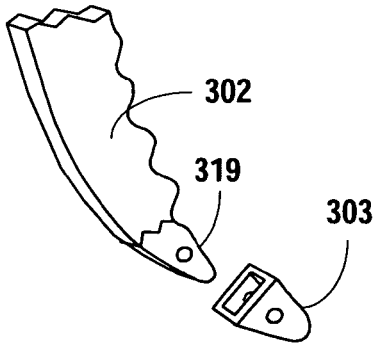
FIG. 2B is a partial side elevational view of a tine tip showing engagement with a tip tooth.

FIG. 2B shows that tines 302 may include tine teeth 303 at tine tips 319. Tine teeth 303 may be welded to tine tips or attached by conventional means, such as bolting.

As seen with reference to FIGS. 1, 1A, 3, and 4, it may be seen that there are six rotating pivot points on Applicant's novel device, three per side. Pivot point 110 pivots the claw or thumb about the bucket. A second pivot point 109 pivots the forward end of cylinders 402 with respect to the thumb. Third pivot point at PV pivots the rear of the hydraulic cylinders with respect to the bucket. It is seen that for the three pivot points on each side, six total, each of the six pivots on fixed pins 321, which pins are removably retained on pin retainers 320 as best seen in FIG. 4.

FIGS. 1A and 1B illustrate Applicant's thumb applied to buckets having recessed ears or receptor cavity side plates 214. The recessed ears typically have fixed pins or members 212-1 and 212-2 and these buckets are known in the prior art, for engaging with quick coupler devices known in the art.

FIGS. 1C-1F illustrate Applicant's novel thumb and bucket combination used with external ears. Buckets with external ears 217-1 and 217-2 typically are provided with removable pins or members 212-1 and 212-2 (for engaging retaining collars) and may be used with a quick coupler or with a regular hookup (non-quick coupler). Quick couplers are also known as "pin grabber" couplers.

Figure 1C:
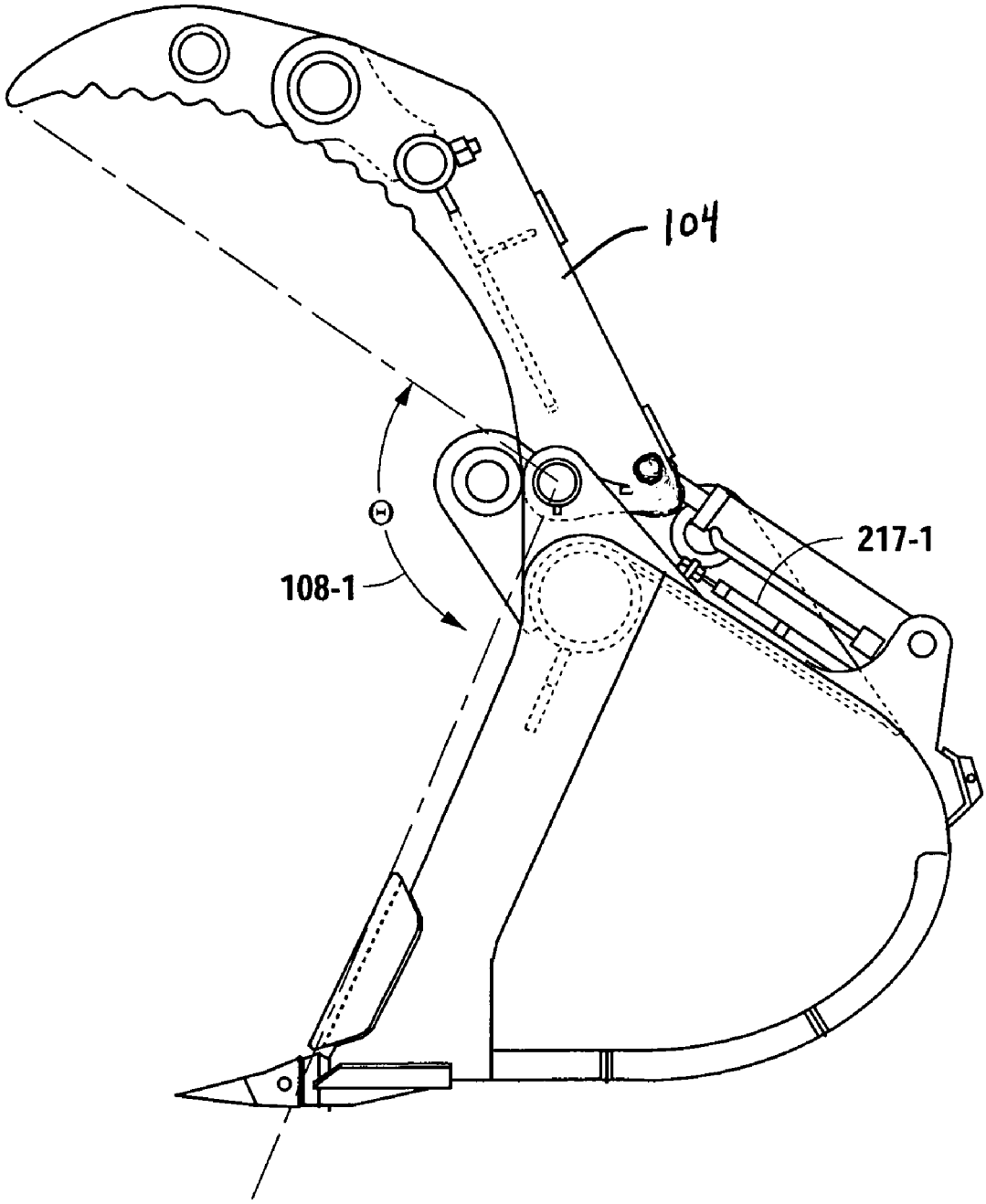
FIGS. 1C, 1D, 1E, and 1F are views of Applicant's prehensile bucket having external (non-recessed) ears for engagement to an excavator with or without a quick coupler receptor.
Figure 1D:
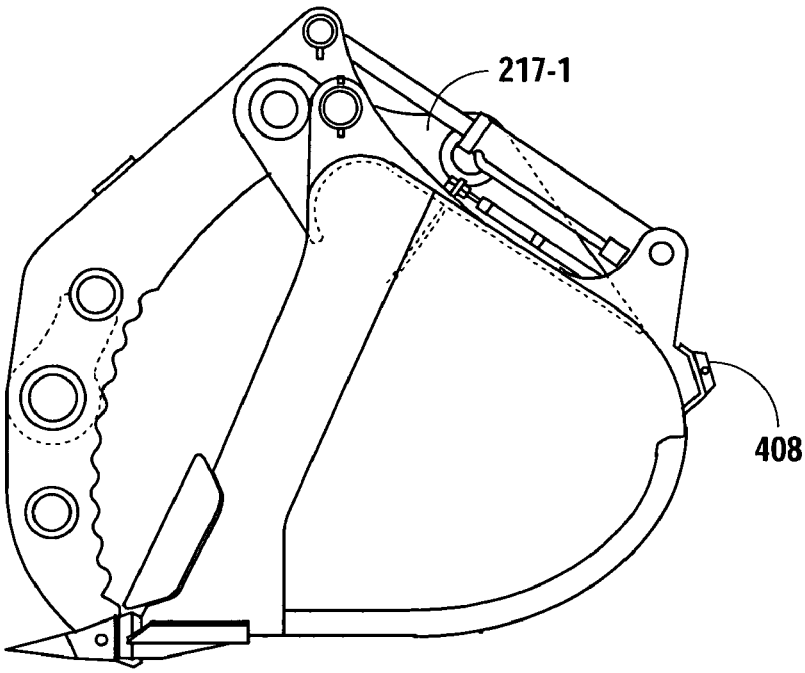

It is seen with respect to FIGS. 1C and 1D that the general arrangement of the engagement of the claw or thumb and the ears is the same as that set forth with the recessed ears. However, it may be seen that the ears or plates for mounting the thumb to the bucket are typically adjacent the upper removable pin of the external ears. The upper pin member 212-1 and/or lower pin member 212-2, when mounted on the external ears (as in FIGS. 1C-1F) may be typically removable, using retainer collars and fasteners on the outboard walls of the external ears.

Figure 1E:
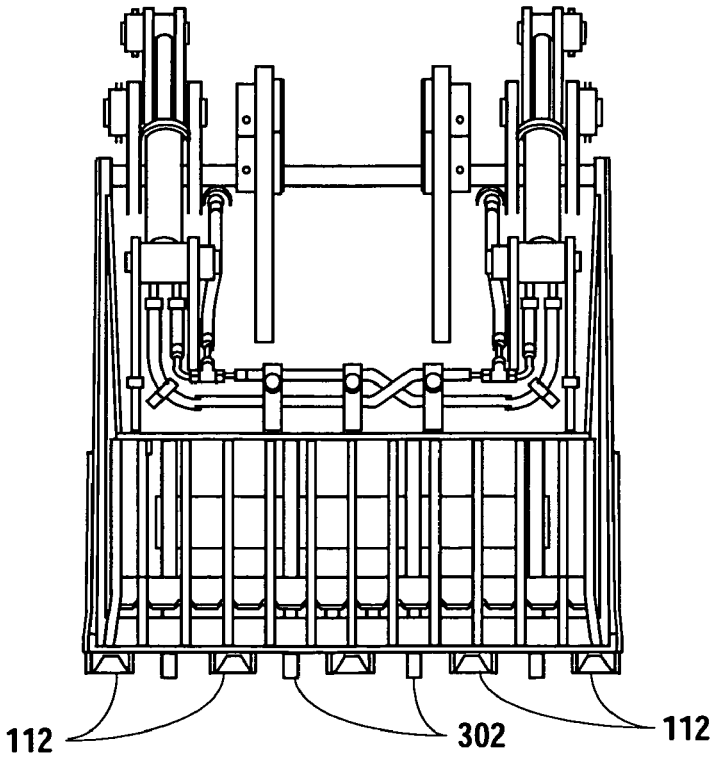
Figure 1F:
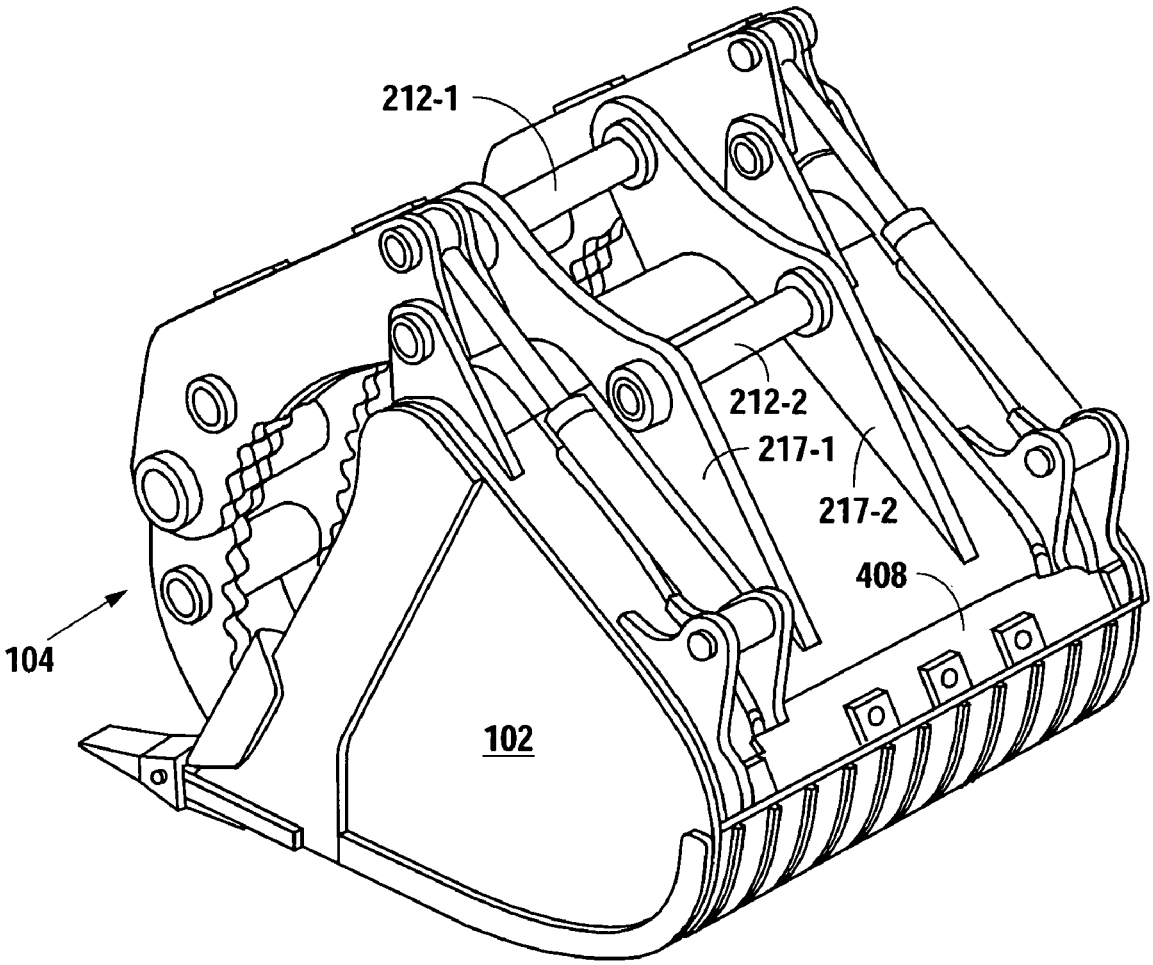

Turning now to FIGS. 1, 1F, and 5, it is seen that a bent plate cover 408 may be provided for protection of at least some of the hydraulic hoses 502 comprising hydraulic subsystem 106 that are used to drive cylinders 402-1 and 402-2. More specifically, it is seen that bent plate cover 408 may be mounted transversely to the bucket typically below where cylinders join to bucket (see FIG. 1A). It is also seen that fasteners (not shown) may engage hydraulic hose retaining blocks 504, here three, which are cup-shaped and can retain in the cups thereof at least some of the hydraulic hoses as seen in FIG. 5. Blocks 504 can be welded to the bucket and threaded to receive fasteners. Fasteners (not shown) would thread into the retaining blocks and hold the bent plate cover 408 thereto. Bent plate cover 408 may be bent on the upper and lower edges as shown to help protect the hoses or it may be flat.

FIG. 3 discloses further details of Applicant's novel wear pad 340, which may be made of durable plastic (such as Acetal). The wear pad is typically provided transverse to thumb 104 and positioned at a point where the thumb, when extended, may come into contact with the stick of the excavator. Here, such a location is seen to be on torque tube 304-1. Wear pad 340 may be mounted to a pair of fasteners projecting from a torque tube and a pair of angle iron brackets 342 adjacent the upper and lower borders of the wear pad. The angle iron would typically be welded to the torque tube so that the wear pad can be replaced by removing bolts (not shown) at the end of the fasteners. Typically the wear pad would be mounted to the torque tube or other thumb member at an angle such that its upper face would strike the stick square so that it is flush with the stick. For different excavators, these angles are different, but could be readily determined by one of ordinary skill in the art. Wear pad 340 may come in a variety of widths to match up to the stick. Wear pad 340 is typically wider than the stick and may be in the range of 8 to 30 inches.

FIG. 3 also illustrates the use of multiple torque tubes to brace the tines, which torque tubes are spaced apart from spaced apart tines, forming a grid-like pattern. This avoids blindspots that would otherwise occur if thumb 104 as in an optional embodiment had plate-like or solid covers. The tines may be laterally spaced apart by a lateral spacing member, which may or may not be torque tubes and may be one or more tabular sheets.

FIGS. 1B and 1E illustrate the use of Applicant's novel thumb 104 with respect to a skeleton bucket, as compared to a solid bucket as seen in the other embodiments. It is seen that a tine is a member that extends at least partially across the mouth of the bucket and generally perpendicular to the bottom front edge of the bucket. The near ends of the tine may or may not couple to the bucket. Typically, the outermost pair of tines may pivotally engage the bucket, but other pairs other than the outermost pair may engage the bucket. Nor does the tine pair pivotally engaging the bucket have to be the same pair that pivotally engages the cylinders. Each tine may be a single piece or constructed of several pieces. Each tine may extend all or part way across the mouth.

While the invention has been described in connection with one or more preferred embodiments, it is not intended to limit the invention to the particular forms set forth, but on the contrary it is intended to cover such alternatives, modifications and equivalents as may be included within the spirit and scope of the invention as defined by the appended claims.

What is claimed is:

1. An attachment for an engineering vehicle having a stick and an engineering vehicle hydraulic system, the attachment comprising:

a bucket having a cavity, a lower front edge, a top wall, a bottom wall, a mouth, a top front edge, side edges, and a curved portion, the bucket having teeth at the lower front edge thereof, the teeth having interteeth spaces, the bucket including a pair of spaced apart thumb support members and a pair of thumb retainer pins engaged therewith, the bucket having a pair of spaced apart hydraulic cylinder engaging members located spaced away from the thumb support members on the bucket external walls and toward the curved portion of the bucket, the hydraulic cylinder engaging members including a pair of hydraulic cylinder retainer pins, the bucket including a stick engaging member mounted thereupon, the stick engaging member located inboard of the thumb support members and hydraulic cylinder engaging members;

a pair of hydraulic cylinders, each hydraulic cylinder having a first end and a second end;

a thumb for pivotal engagement with the bucket and moving between a closed and an open position, the thumb having a multiplicity of tines, the tines trending typically transversely at least partially across the mouth of the bucket, the tines having tine tips at removed ends thereof, the multiplicity of tines including a pair of outboard tines, each tine of the outboard pair with a near end adapted to engage one of the thumb support members of the bucket, and further adapted to engage the first end of one of the hydraulic cylinders, the thumb including at least one spacing member, the tines laterally spaced apart from one another by the at least one spacing member;

wherein a second end of the hydraulic cylinders pivotally engage the bucket at the hydraulic cylinder engaging members of the bucket and a first end of the hydraulic cylinders engage the thumb at near ends of the tines;

wherein the thumb and bucket mouth define a jaw; and further including a hydraulic subsystem for fluidly engaging the hydraulic cylinders to the hydraulic system of the engineering vehicle.

2. The attachment of claim 1, wherein the hydraulic subsystem includes conduits configured to provide hydraulic fluid to the hydraulic cylinders, wherein at least one of the conduits is a hard-line conduit mounted to at least one of the hydraulic cylinders.

3. The attachment of claim 1, wherein the volumetric capacity of the bucket is between 0.7 and 3.0 cubic yards.

4. The attachment of claim 1, wherein the tines are constructed of metal plates with a thickness between ¾ inches and 1¾ inches.

5. The attachment of claim 1, wherein the upper and lower stick engaging members are adapted to be recessed into the bucket.

6. The attachment of claim 1, wherein the upper and lower stick engaging members are mounted on external ears.

7. The attachment of claim 1, wherein the thumb includes a wear pad.

8. The attachment of claim 1, wherein the bucket includes a plate cover over at least some of the lines of the hydraulic subsystem.

9. The attachment of claim 1, wherein the first end of the cylinders includes grease fittings, and the second end of the cylinders include grease fittings.

10. The attachment of claim 9, wherein the thumb includes pivot arm bosses to engage the near end of the outboard pair of tines to the thumb support members.

11. The attachment of claim 10, wherein the pivot arm bosses include grease fittings.

12. The attachment of claim 1, wherein the hydraulic subsystem includes a lever mounted in a control cab of the engineering vehicle, the lever for expanding and contracting the jaw.

13. The attachment of claim 1, further including pin retainer collars for engaging at least one of the stick engaging members as the at least one stick engaging member may be removed.

14. The attachment of claim 1, wherein the engineering vehicle has a quick couple connector and wherein the bucket is adapted to engage the same.

15. The attachment of claim 14, wherein the stick engaging members are fully recessed within the bucket member.

16. The attachment of claim 1, wherein the thumb includes a boss fitting, the boss fitting adapted to accept a grease fitting.

17. The attachment of claim 1, wherein the hydraulic subsystem includes conduits and wherein at least one of the conduits is a hard-line conduit.

18. The attachment of claim 17 further comprising port blocks in fluid communication with the hard-line conduit.

19. The attachment of claim 1 further comprising a bent plate cover.

20. The attachment of claim 1, wherein the thumb comprises at least three tines.

21. The attachment of claim 1, further comprising cylinders placed to provide transverse reinforcement to the plurality of tines.

22. The attachment of claim 1, wherein at least two of the tines is includes at least two plates adapted to join the bucket and cylinders.

23. The attachment of claim 22, wherein the thumb includes an arm spacer separating at least one of the two plates from another of the plates; a pair of bosses; and a pair of replaceable bushing configured to fit within the bosses.

24. The attachment of claim 1, wherein the thumb is operable to rotate through a jaw angle of at least seventy-five degrees.

25. The attachment of claim 1, the bucket further comprising a side cutter affixed to an edge of the bucket.

26. An attachment for an engineering vehicle having a stick and an engineering vehicle hydraulic system, the attachment comprising:

a bucket having a cavity with a volumetric capacity between 0.7 and 3.0 cubic yards, the bucket having a top wall, a bottom wall, a curved wall portion, a mouth, a lower front edge, a top front edge, and side edges, the bucket having teeth at the lower front edge thereof, the teeth having interteeth spaces, the bucket including a pair of spaced apart thumb support members and a pair of thumb retainer pins engaged therewith, the bucket having a pair of spaced apart hydraulic cylinder engaging members located spaced away from the thumb support members on the bucket top wall and toward the curved wall portion of the bucket, the hydraulic cylinder engaging members including a pair of hydraulic cylinder retainer pins, the bucket including upper and lower stick engaging members mounted thereupon and recessed into the bucket, the stick engaging members located inboard of the thumb support members and hydraulic cylinder engaging members, the bucket further including a side cutter affixed to an edge of the bucket;

a pair of hydraulic cylinders, each hydraulic cylinder having a first end and a second end;

a thumb for pivotal engagement with the bucket and adapted to move between a closed and an open position, the thumb having at least three tines constructed of metal plates with a thickness between ¾ inch and 1¾ inches, the tines trending typically transversely at least partially across the mouth of the bucket, the tines having tine tips at removed ends thereof, the at least three tines including a pair of outboard tines, each tine of the outboard pair adapted to engage the first end of one of the hydraulic cylinders, the thumb including at least one spacing member, the tines laterally spaced apart from one another by the at least one spacing member, the thumb further including a wear pad and a multiplicity of torque tubes placed to provide transverse reinforcement to the plurality of tines and further including boss fittings, the boss fittings adapted to accept a grease fitting;

wherein a second end of the hydraulic cylinders pivotally engage the bucket at the hydraulic cylinder engaging members of the bucket and a first end of the hydraulic cylinders engage the thumb at near ends of the tines;

wherein the thumb and bucket mouth define a jaw;

wherein the thumb is operable to rotate through a jaw angle of at least eighty-nine degrees;

a hydraulic subsystem for fluidly engaging the hydraulic cylinders to the hydraulic system of the engineering vehicle, the hydraulic subsystem including conduits configured to provide hydraulic fluid to the hydraulic cylinders, wherein at least one of the conduits is a hard-line conduit mounted to at least one of the hydraulic cylinders, further including a port block in fluid communication with the hard-line conduit, and wherein a bent plate covers at least some hydraulic lines of the hydraulic subsystem.

* * * * *